United States Patent [19]

Tate, Jr. et al.

[11] Patent Number: 4,649,712

[45] Date of Patent: Mar. 17, 1987

[54] THERMOSTAT MOUNTING

[75] Inventors: Ralph Tate, Jr.; Robert H. O. Kraemer, both of Center Township, Vanderburgh County, Ind.

[73] Assignee: Whirlpool Corporation, Benton Harbor, Mich.

[21] Appl. No.: 810,027

[22] Filed: Dec. 17, 1985

[51] Int. Cl.[4] ..... F25C 1/04

[52] U.S. Cl. ..... 62/137; 279/79; 403/329

[58] Field of Search ..... 337/380, 112; 374/206, 374/207, 208; 24/594, 596, 617, 291, 292; 403/329; 248/27.3; 279/79, 16, 18, 46 R; 267/158, 165; 62/137

[56] References Cited

U.S. PATENT DOCUMENTS

| | | | |
|---|---|---|---|
| 897,410 | 9/1908 | Ross | 279/79 X |
| 1,052,077 | 2/1913 | McMillan | 279/46 |
| 1,955,648 | 4/1934 | Nickler | 292/288 |
| 2,083,509 | 6/1937 | Schmidt | 337/112 X |
| 2,435,675 | 2/1948 | Curtis | 236/34 |
| 2,520,739 | 8/1950 | Shaw | 403/329 X |
| 2,790,961 | 4/1957 | Del Camp | 248/27.3 X |
| 3,094,738 | 6/1963 | Chase | 16/49 |
| 3,101,922 | 8/1963 | Moody et al. | 248/27.3 |
| 3,153,852 | 10/1964 | Freeman | 279/79 X |
| 3,163,018 | 12/1964 | Shaw | 62/137 |
| 3,254,884 | 6/1966 | Long et al. | 267/1 |
| 3,316,375 | 4/1967 | Tyler et al. | 200/140 |
| 3,362,182 | 1/1968 | Walker | 62/137 |
| 3,422,502 | 1/1969 | McCarthy | 403/329 X |
| 3,826,024 | 7/1974 | Petersen | 279/79 X |
| 3,858,140 | 12/1974 | Hancock | 337/88 |
| 4,227,594 | 10/1980 | Kluger | 248/27.3 X |

*Primary Examiner*—William E. Tapolcai

*Attorney, Agent, or Firm*—Wood, Dalton, Phillips, Mason & Rowe

[57] ABSTRACT

A retention system for supporting a device on a first stationary member to have biased abutment with a cooperating second stationary member removably secured to the first stationary member. The system includes at least one resilient clip carried by the first stationary member and having a portion resiliently frictionally engaging the device so as to effectively retain the device in association with the first stationary member prior to the mounting of the second stationary member thereto. The spring clip further includes an end portion biasing the device outwardly from the first stationary member to be engaged by the second stationary member when the second stationary member is mounted to the first stationary member. The clip is removably retained in a slotted portion of the first stationary member for facilitated installation.

16 Claims, 5 Drawing Figures

FIG. 1
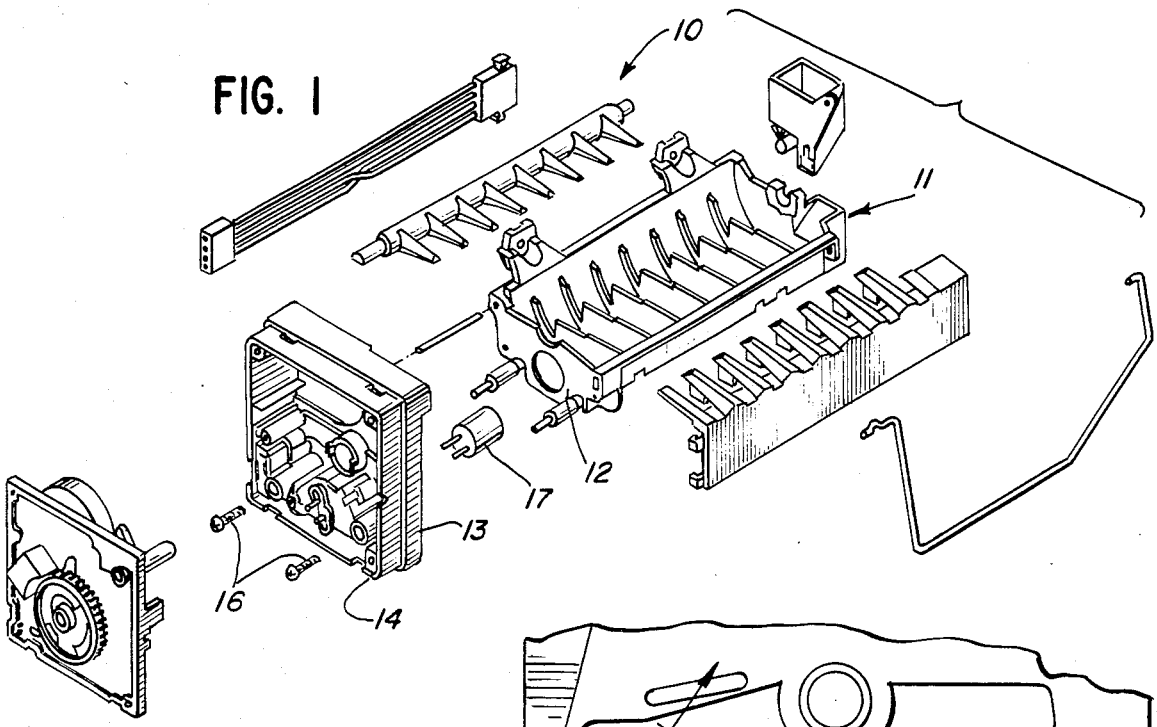
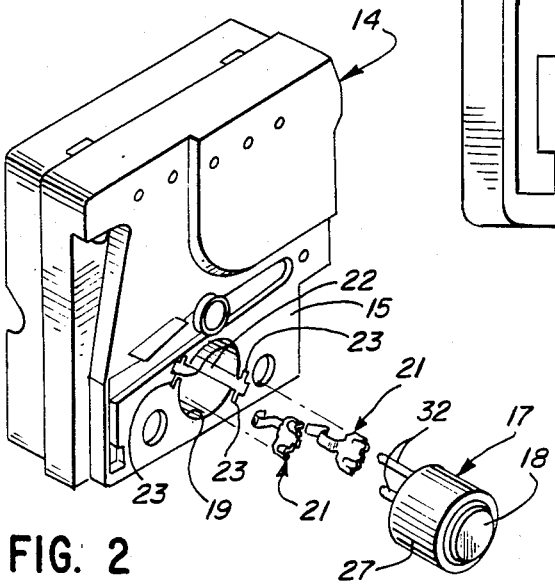
FIG. 2
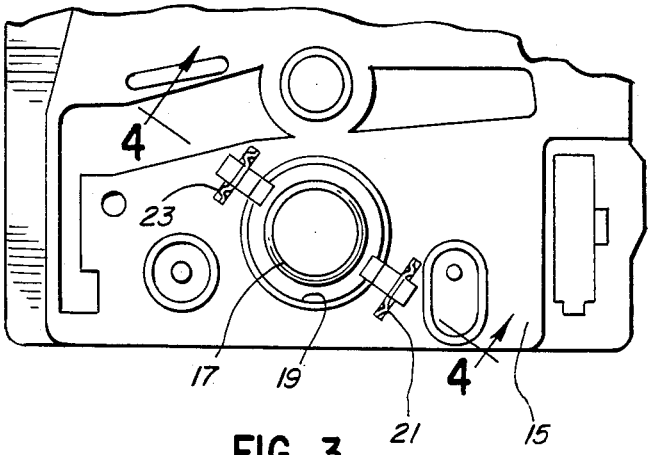
FIG. 3
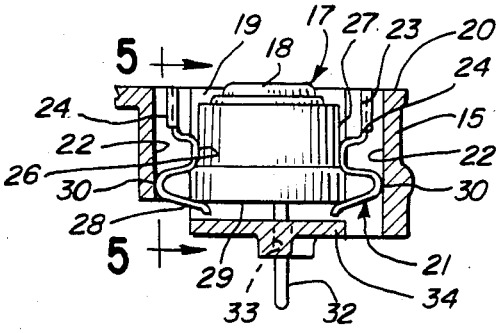
FIG. 4
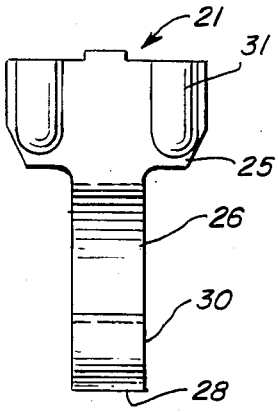
FIG. 5

THERMOSTAT MOUNTING

BACKGROUND OF THE INVENTION

1. Field of the Invention

This invention relates to thermostat mountings and, in particular, to mountings for thermostats in appliances, such as ice makers.

2. Description of the Background Art

One conventional use of thermostats is to sense the temperature of the mold in automatic ice makers. Determination of the temperature condition of the mold is utilized to control the forming of the ice bodies and the heating of the mold in the harvesting operation.

To provide proper thermal transfer relationship between the thermostat and the mold, the thermal sensor is typically a bimetallic sensor urged into spring-biased contact with the mold. One such thermostat arrangement for use in an ice maker is illustrated in U.S. Pat. No. 3,163,018 of Lyle F. Shaw.

A problem has arisen in the thermostatic devices of the prior art in that the conventional thermostat mounting means permit movement of the thermostat relative to the control and other components of the ice maker, such as during the subassembly stage of manufacture, and more specifically, prior to the time the control housing is mounted in association with the mold.

Another problem arises during servicing of the ice maker when the control housing may be separated from the mold. The loose arrangement of the thermostat and its associated mounting means permits these components to fall out of the housing. Reassembly has been found to be quite difficult in the field. One attempted solution to this problem is illustrated in U.S. Pat. No. 3,362,182 of Frank M. Walker, which utilizes relatively complicated and expensive fasteners requiring removal of the fasteners during the servicing operation in order to remove the thermostat, as desired.

SUMMARY OF THE INVENTION

The present invention comprehends an improved means for retaining a device, such as a thermostat, in association with a housing during assembly of an apparatus, and subsequently maintaining biased heat thermal relationship with an associated wall member in the assembled arrangement of the apparatus.

The invention comprehends provision of an improved means for supporting the thermostat in a recessed portion of the housing.

In the illustrated embodiment, the supporting means comprises a resilient clip removably received in the housing recess.

The clip is arranged to provide a biasing of the thermostat toward the wall member, the temperature of which is intended to be sensed by the thermostat.

In the illustrated embodiment, the clip is defined by a U-shaped middle portion defining a center extending at opposite ends into a first leg and a second leg, the center parallel with the main axis, a mounting portion continuous with the first leg and extending away from the middle portion parallel the main axis, mounting means extending from the mounting portion for attaching the clip to a stationary member, a U-shaped shoulder portion continuous with the second leg and extending away from the middle portion, the shoulder portion comprising a return bend to the middle portion, and an end portion continuous with the shoulder portion and extending in a direction generally perpendicular the main axis.

More specifically, in the illustrated embodiment, the invention is directed to the provision of improved means for sensing the temperature of a wall associated with a support provided with an outwardly opening recess. The temperature sensing means includes a thermostat having an outer sensing portion, a midportion, and an inner end surface, support means for supporting the thermostat in the recess with the sensing portion outermost, the support means comprising a pair of spring clips mounted one each to the support at opposite sides of the recess, each clip being defined by an outer mounting portion removably retained in association with the support at an outer end portion of the recess, a turned midportion projecting yieldably into the recess for resiliently frictionally engaging the midportion of the thermostat in the recess, and a turned inner end portion for abutment by the inner end surface of the thermostat in the recess for resiliently limiting insertion of the thermostat inwardly into the recess to a disposition wherein the outer sensing portion of the thermostat is biased by the turned inner end of the spring clip to be disposed outwardly of the support, means for mounting the member in association with the support with the wall juxtaposed to the outer end of the recess to resiliently urge the outer end of the thermostat into the outer end of the recess against the biasing action of the turned inner end of the spring clip and thereby maintain thermal transfer association between the sensing portion of the thermostat and the wall.

In the illustrated embodiment, the support is provided with means defining a pair of rectilinear slots in the support opening tranversely into the recess at diametrically opposite sides thereof.

Still further in the illustrated embodiment, the spring clip includes a transversely outwardly projecting retaining portion intermediate the midportion and the inner end of the spring clip engaging the support for supporting the midportion and inner end against movement transversely away from the thermostat.

The mounting means of the present invention is extremely simple and economical of construction, while yet providing the highly desirable features discussed above.

BRIEF DESCRIPTION OF THE DRAWING

Other features and advantages of the invention will be apparent from the following description taken in connection with the accompanying drawing wherein:

FIG. 1 is an exploded perspective view of an apparatus having a mounting means embodying the invention;

FIG. 2 is an exploded perspective view illustrating a mounting of the thermostat in the housing of the apparatus of FIG. 1 by the mounting means embodying the invention;

FIG. 3 is a fragmentary elevation of the apparatus illustrating a thermostat mounted within a recess therein;

FIG. 4 is a fragmentary section taken substantially along the line 4—4 of FIG. 3; and FIG. 5 is an enlarged side elevation of the mounting means spring clip.

DESCRIPTION OF THE PREFERRED EMBODIMENT

In the illustrative embodiment of the invention as disclosed in the drawing, an ice maker generally designated 10 is provided with a mold generally designated 11 in which ice bodies are formed. The mold defines a front wall 12 to which is removably mounted a housing 13 of a control generally designated 14 for controlling the automatic forming of ice bodies in mold 11.

In the illustrated embodiment, a rear wall 15 of the control housing 13 is secured to the front wall 12 of the mold by suitable fastening means, such as screws 16.

The temperature of mold 11 is sensed by a thermostat 17 having a sensing end 18 intended to be urged into thermal transfer association with the mold front wall 12.

The thermostat is removably installed in a cylindrical recess 19 in housing wall 15 to have the sensing end portion 18 of the thermostat biased to project forwardly of the front surface 20 of the rear wall 15, as illustrated in FIG. 4. For this purpose, a pair of spring clips generally designated 21 are provided in a pair of diametrically opposed slots 22 opening radially inwardly to recess 19 and longitudinally outwardly through surface 20, as illustrated in FIG. 4. Slots 22 extend fully through the wall 15, as shown in FIG. 4. At the outer end of the slots, a pair of short, transverse recesses 23 extend from the opposite sides thereof, terminating inwardly in a stop surface 24.

Thermostat 17 is removably retained in recess 19 by the spring clips 21, as shown in FIG. 4. As further illustrated in FIG. 5, each spring clip includes an outer mounting portion 25, which is removably retained in association with the wall, or support, 15 in the outer transverse recesses 23.

The spring clip further includes an inturned, U-shaped midportion 26 resiliently frictionally engaging the midportion 27 of thermostat 17 in the recess, as shown in FIG. 4.

As further shown, the spring clip includes an inturned distal inner end portion 28 for abutment by the inner end surface 29 of the thermostat when the thermostat 17 is installed in recess 19, as shown in FIG. 4.

The disposition of the inner end portion 28 of the spring clip 21 is preselected to cause the sensing end portion 18 of thermostat 17 to project slightly outwardly of the plane of surface 20 through which recess 19 opens, as further illustrated in FIG. 4. However, when the mold 11 is secured to the rear wall 15 of control 14, as by screws 16, front wall 12 of the mold bears against the thermostat sensing portion 18 urging the thermostat against the springy action of the spring clip end portions 28 so as to bring the thermostat sensing portion 18 into biased flush relationship with the surface 20, thereby maintaining efficient thermal transfer association of the thermostat with the mold for improved sensing of the mold temperature conditions in the operation of the ice maker 10.

As further shown in FIGS. 4 and 5, each spring clip further defines a transversely outwardly projecting retaining portion 30 intermediate midportion 26 and end portion 28, which engages the rear wall 15 for supporting the spring clip midportion and inner end portion against movement transversely outwardly away from the thermostat. In the illustrated embodiment, the retaining portion 30 comprises a U-shaped portion having its bight engaging rear wall 15 in its slot 22.

The configuration of the inturned U-shaped midportion 26 and outturned U-shaped retaining portion 30 is preselected to cause midportion 27 of the thermostat to be resiliently frictionally engaged by spring clip midportions 26, thereby effectively preliminarily retaining the thermostat in association with the housing wall for facilitated assembly of the apparatus, while yet permitting facilitated removal of the thermostat when desired.

As best seen in FIG. 5, mounting portion 25 of each spring clip is provided with elongated bosses 31 preselected to have slidable frictional fit with the confronting surface of the recess 23 when the spring clip is inserted in the slot 22, thereby effectively retaining the spring clip in association with the control housing wall 15 for facilitated assembly of the apparatus, while yet permitting withdrawal of the spring clip from the wall 15 when desired.

As illustrated in FIG. 2, the spring clips are installed simply by longitudinal insertion thereof into the slots 22 and 23, and the thermostat is installed by coaxial insertion thereof into recess 19 from the position of FIG. 2 to the installed arrangement of FIGS. 3 and 4.

As shown, the thermostat may include a pair of inwardly projecting male terminals 32 which project through suitable openings 33 in a transverse wall portion 34 at the inner end of recess 19.

Thus, in broad aspect, the invention comprehends the provision of an improved retention system for supporting and biasing a device in a preselected direction, such as along an axis of the device. In the illustrated embodiment, the device comprises a thermostat for use in sensing the temperature of an ice maker mold.

The retention system includes a pair of resilient spring clips 21 having a portion 26 for resiliently frictionally engaging the device and temporarily holding it in association with the support. Each spring clip includes a mounting portion 25 arranged to be removably retained to the support, and includes a leaf-spring inner end portion 28 engaged by the device so as to bias the device outwardly from the support into yieldable engagement with a wall member removably associated with the support serving as a cooperating second stationary member of the assembly.

In the illustrated embodiment, each spring clip comprises a one-piece, low cost element which may be formed of suitable spring metal and adapted to be slidably retained in association with the control housing wall 15 upon simple insertion thereof into the complementary slots provided in the wall.

The foregoing disclosure of specific embodiments is illustrative of the broad inventive concepts comprehended by the invention.

We claim:

1. In an apparatus having a support provided with an outwardly opening recess, and a member having a wall, improved means for sensing the temperature of said wall comprising:

a thermostat having an outer sensing portion, a midportion, and an inner end surface;

support means for supporting said thermostat in said recess with said sensing portion outermost, said support means comprising a pair of spring clips mounted one each to said support at opposite sides of said recess, each clip being defined by an outer mounting portion outwardly removably, inwardly fixedly retained in association with said support at an outer end portion of the recess, a turned midportion projecting yieldably into said recess for resiliently frictionally engaging said midportion of the thermostat in said recess, and a turned inner end portion for abutment by the inner end surface of the thermostat in said recess for resiliently limiting insertion of the thermostat inwardly into said recess to a disposition wherein said outer sensing portion of the thermostat is biased by said turned inner end portion of the spring clip to be disposed outwardly of said support; and means for mounting said member in association with said support with said wall juxtaposed to the outer end of the recess to resiliently urge the outer end of the thermostat into said outer end of the recess against the biasing action of said turned inner end of the spring clip and thereby maintain thermal transfer association between said sensing portion of the thermostat and said wall.

2. The apparatus of claim 1 wherein said midportion of each spring clip comprises a U-shaped portion having a bight portion thereof engaging said midportion of the thermostat.

3. The apparatus of claim 1 wherein said inner end portion of each spring clip comprises a U-shaped portion having a bight portion thereof engaging the support at a position spaced entirely from the thermostat, and an inturned distal leg thereof engaged by said inner end surface of the thermostat.

4. The apparatus of claim 1 wherein said midportion of each spring clip comprises a U-shaped portion having a bight portion thereof engaging said midportion of the thermostat and said inner end portion having a bight portion thereof engaging the support at a position spaced entirely from the thermostat, and an inturned distal leg thereof engaged by said inner end surface of the thermostat.

5. The apparatus of claim 1 wherein said midportion of each spring clip comprises a U-shaped portion having a bight portion thereof engaging said midportion of the thermostat and an outturned outer leg connected to said outer mounting portion of the spring clip.

6. The apparatus of claim 1 wherein said support defines a pair of outwardly opening retainer slots at opposite sides of the outer end of the recess and said outer mounting portions of the spring clips are retained one each in said slots.

7. In an apparatus having a support provided with an outwardly opening recess, and a member having a wall, improved means for sensing the temperature of said wall comprising;

a thermostat having an outer sensing portion, a midportion, and an inner end surface;

support means for supporting said thermostat in said recess with said sensing portion outermost, said support means comprising a pair of spring clips mounted one each to said support at opposite sides of said recess, each clip being defined by an outer mounting portion removably retained in association with said support at an outer end portion of the recess, a turned midportion projecting yieldably into said recess for resiliently frictionally engaging said midportion of the thermostat in said recess, and a turned inner end portion for abutment by the inner end surface of the thermostat in said recess for resiliently limiting insertion of the thermostat inwardly into said recess to a disposition wherein said outer sensing portion of the thermostat is biased by said turned inner end portion of the spring clip to be disposed outwardly of said support; and means for mounting said member in association with said support with said wall juxtaposed to the outer end of the recess to resiliently urge the outer end of the thermostat into said outer end of the recess against the biasing action of said turned inner end of the spring clip and thereby maintain thermal transfer association between said sensing portion of the thermostat and said wall, said support defining a pair of outwardly opening retainer slots at opposite ends of the outer end of the recess and said outer mounting portions of the spring clips being retained one each in said slots, said support defining a stop surface at the inner end of said slots for limiting the inward movement of said outer mounting portions of the spring clips into the slots.

8. In an apparatus having a support provided with an outwardly opening recess, and a member having a wall, improved means for sensing the temperature of said wall comprising:

means defining a pair of rectilinear slots in said support, said slots opening transversely into said recess at diametrically opposite sides thereof;

a thermostat having an outer sensing portion, a midportion, and an inner end surface;

support means for supporting said thermostat in said recess with said sensing portion outermost, said support means comprising a pair of spring clips mounted one each in said slots, each clip being defined by an outer mounting portion outwardly removably, inwardly fixedly retained in association with said support at an outer end portion of the associated slot, a turned midportion projecting yieldably into said recess from the slot for resiliently frictionally engaging said midportion of the thermostat in said recess, and a turned inner end portion for abutment by the inner end surface of the thermostat in said recess for resiliently limiting insertion of the thermostat inwardly into said recess to a disposition wherein said outer sensing portion of the thermostat is biased by said turned inner end portion of the spring clip to be disposed outwardly of said support; and means for mounting said member in association with said support with said wall juxtaposed to the outer end of the recess to resiliently urge the outer end of the thermostat into said outer end of the recess against the biasing action of said turned inner end portion of the spring clip and thereby maintain thermal transfer association between said sensing portion of the thermostat and said wall.

9. The apparatus of claim 8 wherein said support defines a pair of retainer recesses one each adjacent the outer ends of said slots for receiving said outer mounting portion of the respective spring clips to effect the retained association thereof with said support.

10. In an apparatus having a support provided with an outwardly opening recess, and a member having a wall, improved means for sensing the temperature of said wall comprising:

means defining a pair of rectilinear slots in said support opening transversely into said recess at diametrically opposite sides thereof;

a thermostat having an outer sensing portion, a midportion, and an inner end surface;

support means for supporting said thermostat in said recess with said sensing portion outermost, said support means comprising a pair of spring clips mounted one each in said slots, each clip being defined by an outer mounting portion removably retained in association with said support at an outer end portion of the associated slot, a turned midportion projecting yieldably into said recess from the slot for resiliently frictionally engaging said midportion of the thermostat in said recess, and a turned inner end portion for abutment by the inner end surface of the thermostat in said recess for resiliently limiting insertion of the thermostat inwardly into said recess to a disposition wherein said outer sensing portion of the thermostat is biased by said turned inner end portion of the spring clip to be disposed outwardly of said support; and means for mounting said member in association with said support with said wall juxtaposed to the outer end of the recess to resiliently urge the outer end of the thermostat into said outer end of the recess against the biasing action of said turned inner end of the spring clip and thereby maintain thermal transfer association between said sensing portion of the thermostat and said wall, said support defining a pair of retainer recesses one each adjacent the outer ends of said slots for receiving said outer mounting portion of the respective spring clips to effect the retained association thereof with said support, said support defining a stop surface at the inner end of each of said retainer recesses for limiting the inward movement of said outer mounting portions of the spring clips into the slots.

11. The apparatus of claim 10 wherein said stop surface at the inner end of each of said retainer recesses limits the inward movement of said outer mounting portions of the spring clips into the slots to be flush with the support at the outer end of the retainer recesses.

12. In an apparatus having a support provided with an outwardly opening recess, and a member having a wall, improved means for sensing the temperature of said wall comprising:

a thermostat having an outer sensing portion, a midportion, and an inner end surface;

support means for supporting said thermostat in said recess with said sensing portion outermost, said support means comprising a pair of spring clips mounted one each to said support at opposite sides of said recess, each clip being defined by an outer mounting portion outwardly removably, inwardly fixedly retained in association with said support at an outer end portion of the recess, a turned midportion projecting yieldably into said recess for resiliently frictionally engaging said midportion of the thermostat in said recess, an inturned inner end portion for abutment by the inner end surface of the thermostat in said recess for resiliently limiting insertion of the thermostat inwardly into said recess to a disposition wherein said outer sensing portion of the thermostat is biased by said turned inner end of the spring clip to be disposed outwardly of said support, and a transversely outwardly projecting retaining portion intermediate said midportion and said inner end of the spring clip engaging the support for supporting said midportion and inner end against movement transversely away from the thermostat; and means for mounting said member in association with said support with said wall juxtaposed to the outer end of the recess to resiliently urge the outer end of the thermostat into said outer end of the recess against the biasing action of said turned inner end of the spring clip and thereby maintain thermal transfer association between said sensing portion of the thermostat and said wall.

13. The apparatus of claim 12 wherein said retaining portion of the spring clip comprises a U-shaped portion having a bight portion abutting said support and legs connected respectively to said midportion and distal end of the spring clip.

14. The apparatus of claim 12 wherein said retaining portion of the spring clip comprises a U-shaped portion having a bight portion resiliently biased against said support and is continuous with said midportion and distal end of the spring clip.

15. The apparatus of claim 12 wherein said support further defines a pair of rectilinear slots in said support opening transversely into said recess at diametrically opposite sides thereof, and said retaining portion projects into said slots to engage said support.

16. An ice maker assembly comprising:

an ice mold;

a support housing attached to said ice mold comprising a wall member adjacent said ice mold, said wall member having an edge defining a cavity therein opening in the direction of said ice mold;

a temperature sensor mounted in said cavity and defining a sensing surface in contact with said ice mold; and a one-piece clip secured to said support housing, said clip defining means for frictionally retaining said temperature sensor in said cavity and means for biasing said sensing surface against said ice mold, said clip having a mounting portion which is outwardly removably, inwardly fixedly retained by said support.

* * * * *